US011739950B2

(12) United States Patent
Yoshida et al.

(10) Patent No.: US 11,739,950 B2
(45) Date of Patent: Aug. 29, 2023

(54) HOT WATER SUPPLY APPARATUS

(71) Applicant: Mitsubishi Electric Corporation, Tokyo (JP)

(72) Inventors: Jun Yoshida, Tokyo (JP); Keisuke Takayama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 312 days.

(21) Appl. No.: 16/964,238

(22) PCT Filed: Feb. 23, 2018

(86) PCT No.: PCT/JP2018/006727
§ 371 (c)(1),
(2) Date: Jul. 23, 2020

(87) PCT Pub. No.: WO2019/163099
PCT Pub. Date: Aug. 29, 2019

(65) Prior Publication Data

US 2020/0400319 A1 Dec. 24, 2020

(51) Int. Cl.
*F24D 17/02* (2006.01)
*F24H 1/18* (2022.01)
(Continued)

(52) U.S. Cl.
CPC ..... *F24D 17/02* (2013.01); *F24H 1/18* (2013.01); *F24H 4/04* (2013.01);
(Continued)

(58) Field of Classification Search
CPC . F24H 1/18; F24H 4/04; F24H 9/2021; F24H 9/2007; F24D 17/02; F24D 2240/26; F24D 2220/042; F24D 2200/123
See application file for complete search history.

(56) References Cited

U.S. PATENT DOCUMENTS

2018/0051894 A1* 2/2018 Yoshida ..... F24D 17/02
2019/0024944 A1* 1/2019 Teng ..... F24H 9/2007

FOREIGN PATENT DOCUMENTS

CA 2700771 A1 * 2/2011
CN 106152506 A 11/2016
(Continued)

OTHER PUBLICATIONS

Office Action dated Oct. 15, 2021 issued in corresponding CN patent application No. 201880089586.X (and Machine Translation).
(Continued)

*Primary Examiner* — Steven B McAllister
*Assistant Examiner* — John E Bargero
(74) *Attorney, Agent, or Firm* — Posz Law Group, PLC

(57) ABSTRACT

A hot water supply apparatus includes a heat pump device in which a compressor and a heat exchanger are connected, a heat medium circuit connected to the heat pump device via the heat exchanger, a tank that stores water after the water exchanges heat with a heat medium of the heat medium circuit, two tank-temperature detection units attached at different heights to the tank and each detects a temperature of water in the tank, and a controller that controls, by using a value detected by each of the two tank-temperature detection units, a temperature of water in the tank. The controller sets a target hot water supply temperature based on a stored-hot-water temperature detected by one of the two tank temperature detection units and a within-tank temperature difference that is a difference between temperatures within the tank detected by the two tank-temperature detection units.

7 Claims, 4 Drawing Sheets

(51) Int. Cl.
*F24H 4/04* (2006.01)
*F24H 9/20* (2022.01)

(52) U.S. Cl.
CPC .. *F24D 2200/123* (2013.01); *F24D 2220/042* (2013.01); *F24H 9/2007* (2013.01)

(56) References Cited

FOREIGN PATENT DOCUMENTS

| | | | | | |
|---|---|---|---|---|---|
| EP | 2 933 580 | A1 | | 10/2015 | |
| GB | 2353346 | A | * | 2/2001 | ..... F24H 9/2021 |
| JP | S61-153433 | A | | 7/1986 | |
| JP | 2005-009810 | A | | 1/2005 | |
| JP | 2005-127588 | A | | 5/2005 | |
| JP | 2006-078041 | A | | 3/2006 | |
| JP | 2007-132594 | A | | 5/2007 | |
| JP | 2010-169350 | A | | 8/2010 | |
| JP | 2012-063058 | A | | 3/2012 | |
| JP | 2013-013034 | A | | 1/2013 | |
| JP | 2015-203509 | A | | 11/2015 | |
| JP | 2017-129328 | A | | 7/2017 | |
| WO | WO-2016181501 | A1 | * | 11/2016 | |

OTHER PUBLICATIONS

Office Action dated Jan. 29, 2022 issued in corresponding CN patent application No. 201880089586.X (and English machine translation).

Japanese Office Action dated Mar. 16, 2021, issued in corresponding JP Patent Application No. 2020-501958 (and English Machine Translation).

International Search Report of the International Searching Authority dated Apr. 24, 2018 for the corresponding International application No. PCT/JP2018/006727 (and English translation).

Office Action dated Apr. 27, 2021, issued in corresponding CN Patent Application No. 201880089586.X (and English Machine Translation).

* cited by examiner

HOT WATER SUPPLY APPARATUS

CROSS REFERENCE TO RELATED APPLICATION

This application is a U.S. national stage application of International Application No. PCT/JP2018/006727, filed on Feb. 23, 2018, the contents of which are incorporated herein by reference.

TECHNICAL FIELD

The present disclosure relates to a hot water supply apparatus that uses a heat pump device as a heat source.

BACKGROUND

Related-art hot water supply apparatuses use a heat pump as a heat source, and include a heat exchanger, a hot water supply tank, and a supply hot water circuit (see, for example, Patent Literature 1). The heat exchanger allows heat exchange between refrigerant, and a heat medium typically represented by water that flows inside the heat exchanger. The supply hot water circuit stores water heated by the heat medium into the hot water supply tank.

A storage type hot water supply apparatus disclosed in Patent Literature 1 performs a hot water supply operation based on the temperature and amount of stored hot water by using the following components: a stored-hot-water-temperature detection unit that detects the temperature of hot water stored in an upper area inside a hot water storage tank; and plural stored-hot-water-amount detection units that each detect the amount of hot water stored in the hot water storage tank.

PATENT LITERATURE

Patent Literature 1: Japanese Unexamined Patent Application Publication No. 2007-132594

The storage-type hot water supply apparatus disclosed in Patent Literature 1 includes a single stored-hot-water-temperature detection unit, and plural stored-hot-water-amount detection units, and detects the amount of hot water stored in the hot water storage tank. The hot water supply apparatus thus has a large number of stored-hot-water-amount detection units, leading to an increased manufacturing cost of the hot water supply apparatus. By contrast, if the hot water supply apparatus has only a small number of stored-hot-water-amount detection units, the hot water supply apparatus is unable to know how much hot water remains. This results in running out of hot water.

SUMMARY

The present disclosure has been made to solve the above-mentioned problem. Accordingly, an object thereof is to provide a hot water supply apparatus that does not run out of hot water and can be manufactured at reduced cost.

A hot water supply apparatus according to an embodiment of the present disclosure includes a heat pump device in which a compressor and a heat exchanger are connected; a heat medium circuit connected to the heat pump device via the heat exchanger; a tank configured to store water after the water exchanges heat with a heat medium of the heat medium circuit, two tank-temperature detection units attached at different heights to the tank, the two tank-temperature detection units each being configured to detect a temperature of water in the tank; and a controller configured to, by using a value detected by each of the two tank-temperature detection units, control a temperature of water in the tank. The controller sets a target hot water supply temperature based on a stored-hot-water temperature and a within-tank temperature difference, the target hot water supply temperature being a target temperature at which water in the tank is to be supplied as hot water, the stored-hot-water temperature being a temperature of stored hot water represented by a value detected by one of the two tank-temperature detection units, the within-tank temperature difference being a difference between temperatures within the tank individually detected by the two tank-temperature detection units.

According to an embodiment of the present disclosure, the amount of remaining hot water is estimated by using two tank-temperature detection units, and a target hot water supply temperature is set such that hot water does not run out based on the estimated amount of remaining hot water and the temperature of stored hot water. As described above, the amount of hot water remaining in the tank is estimated by using a value detected by each of the two tank-temperature detection units. This makes it possible to reduce the number of detection units and consequently manufacturing cost.

DETAILED DESCRIPTION

Embodiment 1

Figure 1:
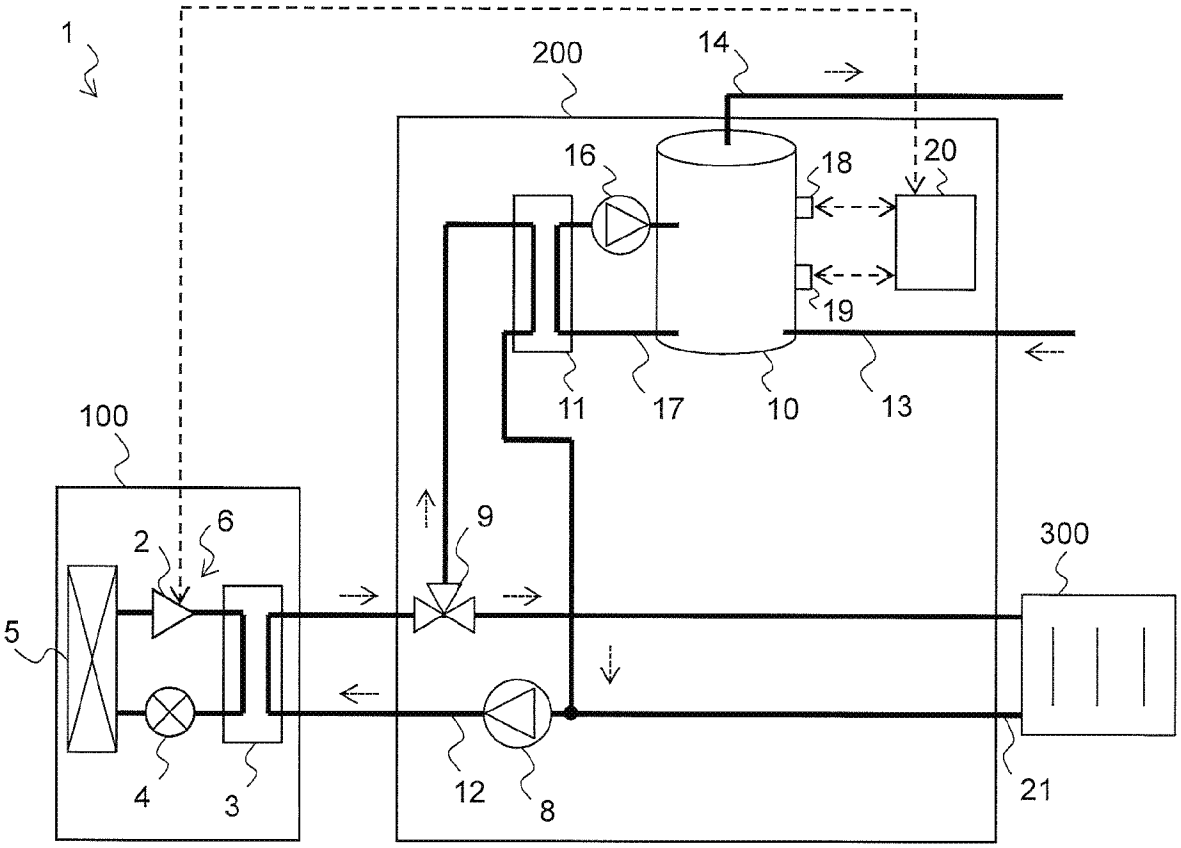
FIG. 1 illustrates an exemplary configuration of a hot water supply apparatus according to Embodiment 1 of the present disclosure.

The configuration of a hot water supply apparatus according to Embodiment 1 will be described below. FIG. 1 illustrates an exemplary configuration of a hot water supply apparatus according to Embodiment 1 of the present disclosure. A hot water supply apparatus 1 includes a heat pump device 100, a hot water supply unit 200, and a heating unit 300.

The heat pump device 100 is a heat pump-type heat source including the following components: a compressor 2; a heat exchanger 3 in which refrigerant and a heat medium exchange heat; an expansion valve 4; and an evaporator 5 in which refrigerant and outdoor air exchange heat. The compressor 2, the heat exchanger 3, the expansion valve 4, and the evaporator 5 are connected by a refrigerant pipe to form a refrigerant circuit 6 in which refrigerant circulates.

The compressor 2 is, for example, an inverter compressor whose capacity can be controlled. The compressor 2 sucks low-temperature, low-pressure gas refrigerant, compresses the sucked refrigerant, and discharges the compressed refrigerant as high-temperature, high-pressure gas refrigerant. The heat exchanger 3 is, for example, a plate heat exchanger. The expansion valve 4 is an expansion device that reduces the pressure of high-pressure refrigerant, thus turning the refrigerant into two-phase gas-liquid refrigerant at low pressure. The evaporator 5 is, for example, a plate-fin heat exchanger. The evaporator 5 allows heat exchange between refrigerant and outside air, thus causing the refrigerant to evaporate.

The hot water supply unit 200 includes the following components: pumps 8 and 16; a three-way valve 9; a tank 10; a tank-side heat exchanger 11; a primary-side heat medium circuit 12 in which a heat medium circulates; a secondary-side water circuit 17 in which water circulates; tank-temperature detection units 18 and 19; and a controller 20. The pump 8, the heat exchanger 3, the three-way valve 9, and the tank-side heat exchanger 11 are connected by a heat medium pipe to form the primary-side heat medium circuit 12. The tank-side heat exchanger 11, the pump 16, and the tank 10 are connected by a water pipe to form the secondary-side water circuit 17. A lower portion of the tank 10 is connected with a water supply pipe 13 that receives supply of water from an external water source, such as city water. For example, a hot water supply pipe 14, which is connected to a hot water supply terminal such as a faucet, a shower, or a bathtub, is connected to an upper portion of the tank 10.

The pump 8 is used to transport a heat medium. The pump 8 circulates, to the primary-side heat medium circuit 12, a heat medium that has exchanged heat with refrigerant in the heat exchanger 3. The pump 16 is used to transport water. The pump 16 circulates water between the tank 10 and the tank-side heat exchanger 11. The three-way valve 9 switches the directions of flow of a heat medium. The three-way valve 9 either causes the incoming heat medium to exit to one of two heat medium pipes, or splits the incoming heat medium into separate streams flowing to the two heat medium pipes.

The tank-side heat exchanger 11 allows heat exchange to be performed between a heat medium, and water stored in the tank 10. The tank-side heat exchanger 11 is, for example, a plate heat exchanger. In Embodiment 1, the tank-side heat exchanger 11 is installed outside the tank 10. The tank 10 stores water that has exchanged heat with the heat medium.

The tank-temperature detection units 18 and 19 are each attached to the tank 10 to detect the temperature of water in the tank 10. The tank-temperature detection units 18 and 19 are installed, for example, at different heights in the direction of gravity of the tank 10. FIG. 1 depicts an exemplary configuration in which the tank-temperature detection unit 18 is positioned above the tank-temperature detection unit 19 in the direction of gravity of the tank 10. The tank-temperature detection units 18 and 19 may not necessarily be positioned as depicted in FIG. 1. One of the tank-temperature detection units 18 and 19 is selected by the user as a temperature detection unit used to detect the temperature of hot water stored in the tank 10.

Figure 2:
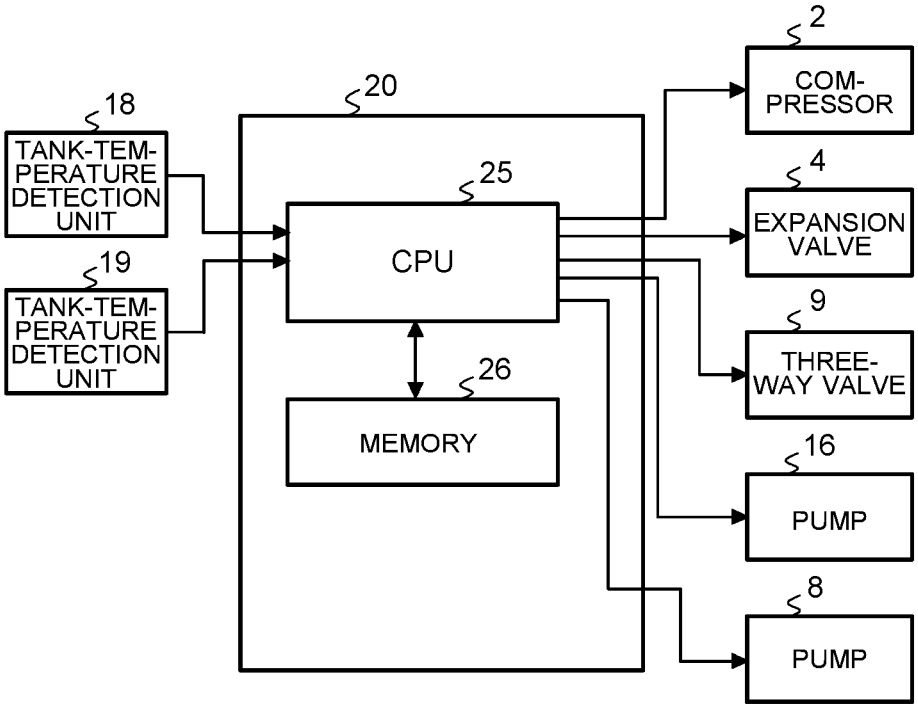
FIG. 2 is a block diagram illustrating an exemplary configuration of a controller illustrated in FIG. 1.

FIG. 2 is a block diagram illustrating an exemplary configuration of the controller illustrated in FIG. 1. The controller 20 is, for example, a microcomputer. The controller 20 includes a memory 26 that stores a program, and a CPU 25 that executes processing in accordance with the program. The CPU 25 executes the program stored in the memory 26, and the controller 20 thus controls the heat pump device 100 and the hot water supply unit 200. When the controller 20 receives an input instructing to perform a hot water supply operation or a heating operation, the controller 20 controls switching of the passages of the three-way valve 9, the respective rotation speeds of the pumps 8 and 16, and the opening degree of the expansion valve 4.

If, regarding a hot water supply operation, the controller 20 determines that there is not enough hot water stored in the tank 10 for the amount of heat requested by the user, the controller 20 operates the hot water supply apparatus 1 in a normal mode that gives priority to preventing running out of hot water. By contrast, if the controller 20 determines that there is enough hot water stored in the tank 10 for the amount of heat requested by the user, the controller 20 operates the hot water supply apparatus 1 in a heat rejection mode that gives priority to saving energy. Based on whether the operating mode is the normal mode or the heat rejection mode, the controller 20 sets a target hot water supply temperature, which is a target value of stored-hot-water temperature, and controls the refrigeration cycle of the refrigerant circuit 6 in accordance with the target hot water supply temperature. For example, in the normal mode, the controller 20 sets the target hot water supply temperature to a preset hot water supply temperature Ts specified by the user, and in the heat rejection mode, the controller 20 sets the target hot water supply temperature to a temperature lower than the preset hot water supply temperature Ts.

A processing device provided to the controller 20 may not necessarily be the CPU 25 but may be a digital signal processor (DSP). A remote control (not illustrated) may be connected to the controller 20. Although the connection between the controller 20 and each of the compressor 2, the tank-temperature detection unit 18, and the tank-temperature detection unit 19 is represented by a dashed line in FIG. 1, the connection between the controller 20 and each of the expansion valve 4, the three-way valve 9, the pump 8, and the pump 16 are not depicted in FIG. 1. The refrigerant circuit 6 may be provided with a temperature sensor and a pressure sensor (not illustrated), and values detected by these sensors may be used for the refrigeration cycle control performed by the controller 20.

The heating unit 300 illustrated in FIG. 1 includes a heating circuit 21 to circulate the heat medium of the primary-side heat medium circuit 12 through the heating unit 300. The heating unit 300 is supplied with a heated heat medium via the primary-side heat medium circuit 12, receives heat from the heat medium, and rejects the heat to an indoor space that is an air-conditioned space.

Although the following description of Embodiment 1 is directed to a case in which the hot water supply apparatus 1 includes the heating unit 300, the hot water supply apparatus 1 is not required to have the heating unit 300. Further, although the following description of Embodiment 1 is directed to a case in which the controller 20 is provided in the hot water supply unit 200, the installation space of the controller 20 is not restricted to the hot water supply unit 200.

The following describes how the hot water supply apparatus 1 operates. When the hot water supply apparatus 1 receives an input instructing to performed one or both of a hot water supply operation and a heating operation, the passages of the three-way valve 9 are switched in accordance with the operation instructed to be performed. Refrigerant that has been increased in temperature and pressure due to the rotation of the compressor 2 exchanges heat in the heat exchanger 3 with the heat medium circulating in the primary-side heat medium circuit 12. The heat medium heated in the heat exchanger 3 is transported by the pump 8 to the primary-side heat medium circuit 12, and then to the tank-side heat exchanger 11 through the three-way valve 9 to thereby perform a hot water supply operation. Water that has undergone heat exchange in the tank-side heat exchanger 11 is transported by the pump 16 for storage into the tank 10. Meanwhile, the heat medium heated in the heat exchanger 3 passes through the heating circuit 21 from the three-way valve 9, and is transported to the heating unit 300, where the heat medium rejects heat indoors to thereby perform a heating operation.

In this way, in accordance with the switching of the passages of the three-way valve 9, the hot water supply unit 200 performs either one of a hot water supply operation and a heating operation, or performs both a hot water supply and heating operation in which both hot water supply and heating are carried out simultaneously. A simultaneous hot water supply and heating operation refers to simultaneously performing a hot water supply operation in which the heat medium heated in the heat exchanger 3 is used to heat water in the tank 10, and a heating operation in which the heat medium heated in the heat exchanger 3 is used by the heating unit 300 to reject heat indoors.

Figure 3:
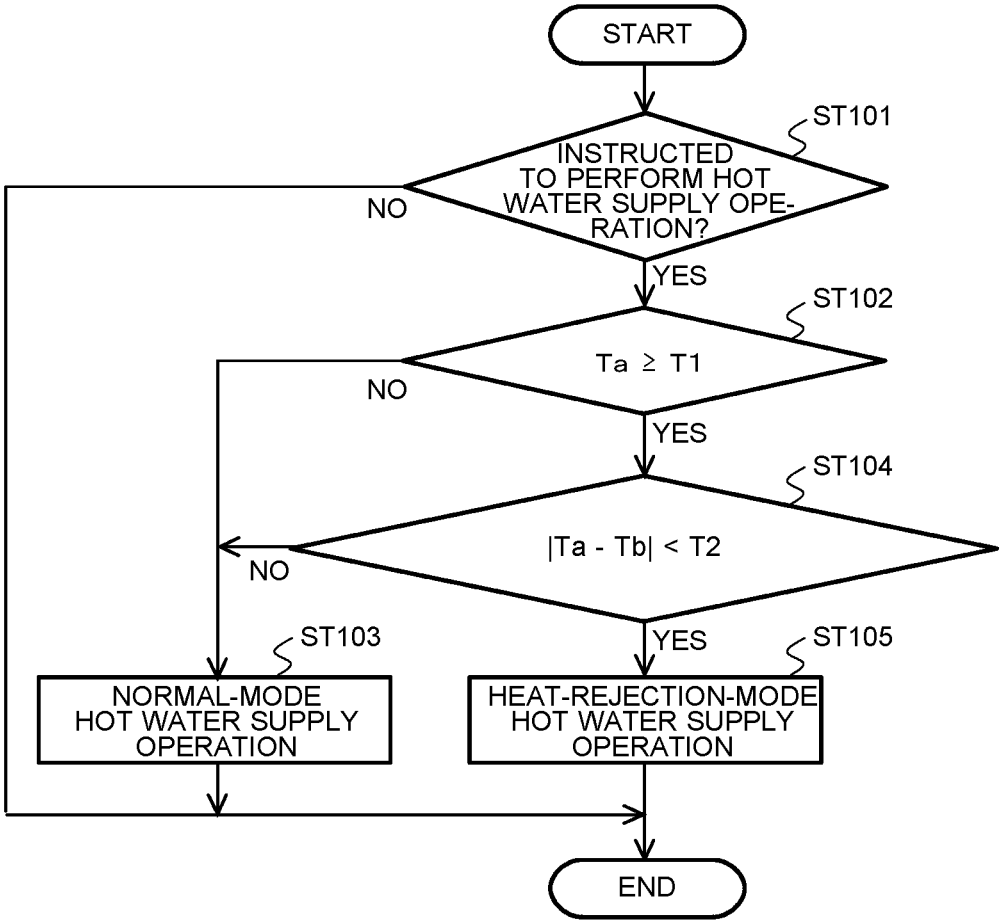
FIG. 3 is a flowchart illustrating the control of hot water supply conducted by the hot water supply apparatus according to Embodiment 1 of the present disclosure.

The following describes the control of hot water supply executed by the hot water supply apparatus 1. FIG. 3 is a flowchart illustrating the control of hot water supply executed by the hot water supply apparatus according to Embodiment 1 of the present disclosure. The procedure illustrated in FIG. 3 is included in the program stored in the memory 26.

The user selects, based on the amount of hot water usage, one of the tank-temperature detection units 18 and 19 as a unit for detecting the temperature of hot water stored in the tank 10. The amount of hot water usage is, for example, the amount of heat required. Referring to FIG. 1, hot water stored in the tank 10 is supplied from an upper part of the tank 10 to a hot water supply terminal (not illustrated) via the hot water supply pipe 14. Water to be heated is supplied to a lower part of the tank 10 from an external water source via the water supply pipe 13. The temperature detected by the tank-temperature detection unit 19 tends to be lower than the temperature detected by the tank-temperature detection unit 18. This means that if the tank-temperature detection unit 19 attached to a lower part of the tank 10 is selected as a unit used to detect the temperature of hot water, the hot water supply apparatus 1 will start its operation earlier.

Now, two cases of hot water usage are compared: filling a bathtub with hot water, and washing dishes with hot water. Filling a bathtub with hot water requires greater hot water usage and higher hot water temperature, and consequently greater amount of heat than washing dishes with hot water. When using hot water to fill a bathtub, the user needs a large amount of hot water at a high temperature. Conceivably, in this case, the user may select the tank-temperature detection unit 19 attached to a lower part of the tank 10 than the tank-temperature detection unit 18. The reason why the user selects the tank-temperature detection unit 19 when using a large amount of hot water is that not starting operation of the hot water supply apparatus 1 early in such a case increases the risk of running out of hot water. By contrast, when using hot water to wash dishes in the kitchen, the user does not need a large amount of hot water. Conceivably, in this case, the user may select the tank-temperature detection unit 18 attached to a higher part of the tank 10 than the tank-temperature detection unit 19.

In the following description, a value detected by one of the tank-temperature detection units 18 and 19 selected by the user is defined as main temperature Ta. A value detected by the other one of the tank-temperature detection units 18 and 19 not selected by the user is defined as sub-temperature Tb.

The user inputs the following pieces of information to the controller 20 via a remote control (not illustrated): a tank-temperature detection unit selected by the user; the preset hot water supply temperature Ts; and an instruction to perform a hot water supply operation. The controller 20 determines at step ST101 whether an instruction to perform a hot water supply operation has been provided. If an instruction to perform a hot water supply operation has been provided, the controller 20 determines whether the main temperature Ta is equal to or higher than a first threshold T1 (step ST102). The first threshold T1 is calculated by the following equation: $T1=Ts+k1$. This calculation equation is stored in the memory 26. In the above equation, k1 is a correction value, which is, for example, 2 [degrees C.]. The first threshold T1 may be a predetermined value.

If it is determined at step ST102 that the main temperature Ta is lower than the first threshold T1, the controller 20 determines not to select the heat rejection mode in the current state, such as during initial start-up of the hot water supply apparatus 1, and performs a hot water supply operation in the normal mode (step ST103). In this case, the controller 20 sets the target hot water supply temperature to the preset hot water supply temperature Ts.

If it is determined at step ST102 that the main temperature Ta is higher than or equal to the first threshold T1, the controller 20 determines whether a within-tank temperature difference, which is the difference between the main temperature Ta and the sub-temperature Tb, is less than a second threshold T2 (step ST104). The second threshold T2 is stored in the memory 26.

If it is determined at step ST104 that $|Ta-Tb|\geq T2$, the controller 20 determines that there is not much hot water remaining in the tank 10, and performs a hot water supply operation in the normal mode, which gives priority to preventing running out of hot water (step ST103). The controller 20 sets the target hot water supply temperature to the preset hot water supply temperature Ts, and controls the hot water supply operation such that the preset hot water supply temperature Ts and the main temperature Ta have the following relationship: $Ts\leq Ta$. As heat rejection from the tank 10 proceeds in the heat rejection mode, the temperature difference within the tank increases. Further, conceivably, the decrease in the amount of remaining hot water due to the heat rejection mode is reflected on the within-tank temperature difference. Therefore, if the within-tank temperature difference is greater than or equal to the second threshold T2, it is assumed that there is not much hot water stored in the tank 10.

If it is determined at step ST104 that $|Ta-Tb|<T2$, the controller 20 performs a hot water supply operation with the target hot water supply operation being set to a heat-rejection-mode target hot water supply temperature T3 (step ST105). The heat-rejection-mode target hot water supply temperature T3 and the main temperature Ta have the following relationship: $T3\leq Ta$. If the within-tank temperature difference as the difference between the main temperature Ta and the sub-temperature Tb is small, it is assumed that the decrease in the amount of remaining hot water due to the heat rejection mode is small and hence a large amount of hot water still remains. Accordingly, the controller 20 gives higher priory to saving energy than to preventing running out of hot water, and thus performs a hot water supply operation with the target hot water supply temperature being set to the heat-rejection-mode target hot water supply temperature T3, which is lower than the preset hot water supply temperature Ts.

In this regard, the absolute value of the within-tank temperature difference, and the second threshold T2 are compared at step ST104 illustrated in FIG. 3 to determine which one of these values is greater or less than the other. Therefore, no matter which one of the tank-temperature detection units 18 and 19 is selected by the user, the estimated amount of remaining hot water is the same. The second threshold T2 may not necessarily be a predetermined value but may be updated by the controller 20 based on the operation history of the hot water supply apparatus 1. For example, if hot water frequency runs out, the controller 20 may decrease the second threshold T2.

The hot water supply apparatus 1 according to Embodiment 1 sets a target hot water supply temperature at which water in the tank 10 is to be supplied as hot water, based on a value detected by one of the two tank-temperature detection units 18 and 19 placed at different heights, and the within-tank temperature difference.

In accordance with Embodiment 1, the controller 20 estimates the amount of remaining hot water by using values individually detected by the two tank-temperature detection units 18 and 19, and selects one of the normal mode and the heat rejection mode as an operation mode based on the estimated amount of remaining hot water and the temperature of stored hot water. In the normal mode, the controller 20 sets the target hot water supply temperature to the preset hot water supply temperature Ts, and performs a hot water supply operation that gives priority to preventing running out of hot water. In the heat rejection mode, the controller 20 sets the target hot water supply temperature to a temperature lower than the stored-hot-water temperature, and performs a hot water supply operation that gives priority to saving energy. This configuration makes it possible to achieve energy saving while ensuring that hot water does not run out. This helps to reduce the operating cost of the hot water supply apparatus 1 while maintaining user comfort. Further, the amount of hot water remaining in the tank 10 is estimated by using values individually detected by the two tank-temperature detection units 18 and 19. Consequently, the hot water supply apparatus 1 needs to have fewer detection units than the apparatus disclosed in Patent Literature 1, leading to reduced manufacturing cost of the hot water supply apparatus 1.

Embodiment 2

In Embodiment 1, the target hot water supply temperature is changed based on the within-tank temperature difference. In Embodiment 2, the rotation speed of the compressor 2 is controlled based on the within-tank temperature difference. In Embodiment 2, components identical to the components described above with reference to Embodiment 1 will be denoted by the same reference signs, and will not be described in further detail.

As illustrated in FIG. 1, the hot water supply apparatus 1 according to Embodiment 2 includes the heat pump device 100, the hot water supply unit 200, and the heating unit 300. In Embodiment 2, a detailed description will not be given of the hot water supply apparatus 1.

The control of hot water supply executed by the hot water supply apparatus 1 according to Embodiment 2 will be described below with reference to the flowchart illustrated in FIG. 3. In the following description, processes similar to the processes in Embodiment 1 described above with reference to FIG. 3 will not be described in further detail.

If it is determined at step ST101 that an instruction to perform a hot water supply operation has been issued, the controller 20 then determines whether the main temperature Ta is equal to or higher than the first threshold T1 (step ST102). If it is determined at step ST102 that the main temperature Ta is lower than the first threshold T1, the controller 20 determines not to select the heat rejection mode in the current state, such as during initial start-up of the hot water supply apparatus 1, and performs a hot water supply operation in the normal mode (step ST103). At step ST103, the controller 20 controls the rotation speed of the compressor 2 to the maximum value.

If it is determined at step ST102 that the main temperature Ta is higher than or equal to the first threshold T1, the controller 20 determines whether the within-tank temperature difference, which is the difference between the main temperature Ta and the sub-temperature Tb, is less than the second threshold T2 (step ST104). If it is determined at step ST104 that $|Ta-Tb| \geq T2$, the controller 20 determines that there is not much hot water remaining in the tank 10. Accordingly, to give priority to preventing running out of hot water, the controller 20 performs a hot water supply operation in the normal mode in which the rotation speed of the compressor 2 is set to the maximum value (step ST103).

If it is determined at step ST104 that $|Ta-Tb| < T2$, the controller 20 performs a hot water supply operation in which the rotation speed of the compressor 2 is controlled to a high-efficiency rotation speed that maximizes operating frequency (step ST105). If the within-tank temperature difference as the difference between the main temperature Ta and the sub-temperature Tb is small, it is assumed that the decrease in the amount of remaining hot water due to the heat rejection mode is small and hence a large amount of hot water still remains. Accordingly, the controller 20 gives higher priority to saving energy than to preventing running out of hot water, and operates the compressor 2 at a high-frequency rotation speed that allows for reduced power consumption.

The hot water supply apparatus 1 according to Embodiment 2 sets the rotation speed of the compressor 2 to a high-frequency rotation speed, if the temperature of stored hot water is higher than or equal to the first threshold T1 and the within-tank temperature difference is less than the second threshold T2. Embodiment 2 not only provides the same effect as that of Embodiment 1, but also helps to reduce the power consumption of the compressor 2 to thereby achieve energy saving. As a result, the operating cost of the hot water supply apparatus 1 can be reduced.

Embodiment 3

In Embodiment 1, the target hot water supply temperature is changed based on the within-tank temperature difference. In Embodiment 3, the rotation speed of the compressor 2 is changed based on the within-tank temperature difference. In Embodiment 3, both the target hot water supply temperature, and the rotation speed of the compressor 2 are changed based on the within-tank temperature difference. In Embodiment 3, components identical to the components described above with reference to Embodiments 1 and 2 will be denoted by the same reference signs, and will not be described in further detail.

In Embodiment 3, the configuration of the hot water supply apparatus 1 will not be described in further detail, and the control of hot water supply will be described with reference to FIG. 3. In the following description, processes similar to the processes in Embodiments 1 and 2 described above with reference to FIG. 3 will not be described in further detail.

If it is determined at step ST102 that the main temperature Ta is lower than the first threshold T1, the controller 20 determines not to select the heat rejection mode in the current state, such as during initial start-up of the hot water supply apparatus 1, and performs a hot water supply operation in the normal mode (step ST103). At step ST103, the controller 20 sets the target hot water supply temperature to the preset hot water supply temperature Ts. Further, the controller 20 maintains the following condition: hot water supply temperature Ts≤main temperature Ta, and sets the rotation speed of the compressor 2 to the maximum value.

If it is determined at step ST104 that |Ta−Tb|≥T2, the controller 20 determines that there is not much hot water remaining in the tank 10. Accordingly, to give priority to preventing running out of hot water, the controller 20 performs a hot water supply operation in the normal mode (step ST103). The control at step ST103 is the same as that mentioned above, and thus will not be described in further detail.

If it is determined at step ST104 that |Ta−Tb|<T2, then at step ST105, the controller 20 sets the target hot water supply temperature to the heat-rejection-mode target hot water supply temperature T3. Further, the controller 20 performs a hot water supply operation in which the controller 20 maintains the following condition: heat-rejection-mode target hot water supply temperature T3≤main temperature Ta, and sets the rotation speed of the compressor 2 to a high-frequency rotation speed. If the within-tank temperature difference as the difference between the main temperature Ta and the sub-temperature Tb is small, it is assumed that the decrease in the amount of remaining hot water due to the heat rejection mode is small and hence a large amount of hot water still remains. Accordingly, the controller 20 gives higher priority to saving energy than to preventing running out of hot water, such that the controller 20 sets the target hot water supply temperature to the heat-rejection-mode target hot water supply temperature T3 and operates the compressor 2 at a high-frequency rotation speed that allows for reduced power consumption.

With the hot water supply apparatus 1 according to Embodiment 3, if the temperature of stored hot water is higher than or equal to the first threshold T1, and the within-tank temperature difference is less than the second threshold T2, the target hot water supply temperature is set to a temperature lower than the stored-hot-water temperature, and the rotation speed of the compressor 2 is set to a high-frequency rotation speed. Therefore, Embodiment 3 allows for greater energy saving, and consequently greater reduction in the operating cost of the hot water supply apparatus 1 than Embodiment 1.

Embodiment 4

In Embodiments 1 to 3, the tank-side heat exchanger 11 is disposed outside the tank 10. In Embodiment 4, a tank-side heat exchanger is disposed inside the tank 10. In Embodiment 4, components identical to the components described above with reference to Embodiment 1 will be denoted by the same reference signs, and will not be described in further detail.

Figure 4:
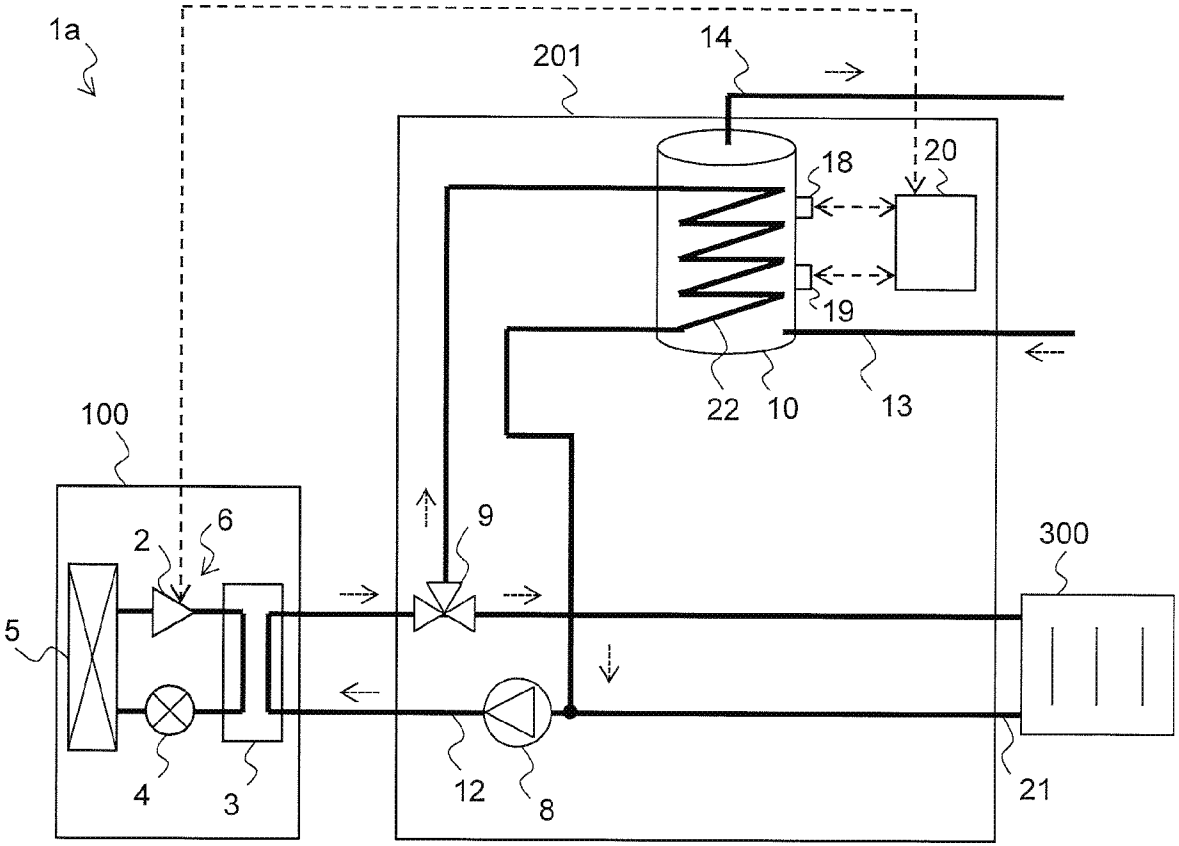
FIG. 4 illustrates an exemplary configuration of a hot water supply apparatus according to Embodiment 4 of the present disclosure.

The configuration of a hot water supply apparatus according to Embodiment 4 will be described below. FIG. 4 illustrates an exemplary configuration of a hot water supply apparatus according to Embodiment 4 of the present disclosure. A hot water supply apparatus 1*a* includes the heat pump device 100, a hot water supply unit 201, and the heating unit 300.

As with the hot water supply unit 200 illustrated in FIG. 1, the hot water supply unit 201 includes the pump 8, the three-way valve 9, the tank 10, and the tank-temperature detection units 18 and 19. The hot water supply unit 201 includes a tank-side heat exchanger 22 instead of the tank-side heat exchanger 11 illustrated in FIG. 1. The tank-side heat exchanger 22 is disposed inside the tank 10. The tank-side heat exchanger 22 is, for example, a coil heat exchanger.

The following describes how the hot water supply apparatus 1*a* operates. When the hot water supply apparatus 1*a* receives an input instructing that one or both of a hot water supply operation and a heating operation be performed, the passages of the three-way valve 9 are switched in accordance with the operation instructed to be performed. Refrigerant that has been increased in temperature and pressure due to the rotation of the compressor 2 exchanges heat in the heat exchanger 3 with the heat medium circulating in the primary-side heat medium circuit 12. The heat medium heated in the heat exchanger 3 is transported by the pump 8 to the primary-side heat medium circuit 12, and then to the tank-side heat exchanger 22 through the three-way valve 9 to thereby perform a hot water supply operation. Water that has undergone heat exchange in the tank-side heat exchanger 22 is stored in the tank 10. Meanwhile, the heat medium heated in the heat exchanger 3 passes through the heating circuit 21 from the three-way valve 9, and is transported to the heating unit 300, where the heat medium rejects heat indoors to thereby perform a heating operation.

In this way, in accordance with the switching of the passages of the three-way valve 9, the hot water supply unit 201 according to Embodiment 4 either performs one of a hot water supply operation and a heating operation, or performs a simultaneous hot water supply and heating operation in which both hot water supply and heating are carried out simultaneously.

In Embodiment 4, the heat medium circulating in the primary-side heat medium circuit 12 exchanges heat with water stored in the tank 10 via the tank-side heat exchanger 22. This configuration makes it possible to reduce loss of heat that occurs when water flowing through the secondary-side water circuit 17 illustrated in FIG. 1 rejects heat to air. Further, the absence of the pump 16 makes it possible to reduce power otherwise consumed by the pump 16.

The control of hot water supply according to Embodiment 4 is performed by a procedure similar to the procedure described above in Embodiment 1 with reference to FIG. 3, and thus will not be described in further detail.

With the hot water supply apparatus 1*a* according to Embodiment 4, the tank-side heat exchanger 22 of the primary-side heat medium circuit 12 is disposed inside the tank 10. With Embodiment 4, not only the same effect as that of Embodiment 1 can be obtained but also thermal efficiency can be improved, leading to reduced operating cost.

Although Embodiment 4 has been described above based on the configuration according to Embodiment 1, each of Embodiments 2 and 3 may be applied to Embodiment 4. Any combination of these embodiments allows for improved energy saving without compromising user comfort, thus making it possible to reduce the manufacturing cost and operating cost of the hot water supply apparatus. Further, the additional effect of each of Embodiment 2 to 4 is obtained.

The invention claimed is:

1. A hot water supply apparatus, comprising:

a heat pump device in which a compressor and a heat exchanger are connected;

a heat medium circuit connected to the heat pump device via the heat exchanger;

a tank configured to store water after the water exchanges heat with a heat medium of the heat medium circuit;

two tank-temperature sensors attached at different heights to the tank, the two tank-temperature sensors each being configured to detect a temperature of water in the tank; and a controller configured to, by using a value detected by each of the two tank-temperature sensors, control a temperature of water in the tank, wherein the controller sets a target hot water supply temperature based on a stored-hot-water temperature and a comparison of a within-tank temperature difference with a first threshold, the target hot water supply temperature being a target temperature at which water in the tank is to be supplied as hot water, the stored-hot-water temperature being a temperature of stored hot water represented by a value detected by one of the two tank-temperature sensors selected by a user, the within-tank temperature difference being a difference between temperatures within the tank individually detected by the two tank-temperature sensors.

2. The hot water supply apparatus of claim 1, wherein if the stored-hot-water temperature is higher than or equal to the first threshold, and the within-tank temperature difference is less than a second threshold, the controller sets the target hot water supply temperature to a temperature lower than the stored-hot-water temperature.

3. The hot water supply apparatus of claim 1, wherein if the stored-hot-water temperature is higher than or equal to the first threshold, and the within-tank temperature difference is less than a second threshold, the controller sets a rotation speed of the compressor to a rotation speed that maximizes operating efficiency.

4. The hot water supply apparatus of claim 1, wherein if the stored-hot-water temperature is lower than the first threshold, or if the within-tank temperature difference is greater than or equal to a second threshold, the controller sets the target hot water supply temperature to a preset hot water supply temperature.

5. The hot water supply apparatus of claim 1, wherein the heat medium circuit includes a tank-side heat exchanger in which a heat medium and water in the tank exchange heat, and wherein the tank-side heat exchanger is disposed inside the tank.

6. The hot water supply apparatus of claim 1, further comprising a heating unit, the heating unit being connected to the heat medium circuit and configured to reject heat to an air-conditioned space.

7. The hot water supply apparatus of claim 1, wherein:

the first threshold is a first temperature threshold, and the controller is further configured to set the target hot water supply temperature based on the within-tank temperature difference being compared to a second temperature threshold.

* * * * *